US012167769B2

(12) United States Patent
Mason

(10) Patent No.: US 12,167,769 B2
(45) Date of Patent: Dec. 17, 2024

(54) SOLE FOR A SPORTS SHOE

(71) Applicant: LTWHP, LLC, Wilmington, DE (US)

(72) Inventor: Angelo Mason, Caerano di San Marco (IT)

(73) Assignee: LTWHP, LLC, New York, NY (US)

( * ) Notice: Subject to any disclaimer, the term of this patent is extended or adjusted under 35 U.S.C. 154(b) by 31 days.

(21) Appl. No.: 17/974,174

(22) Filed: Oct. 26, 2022

(65) Prior Publication Data

US 2023/0180887 A1 Jun. 15, 2023

Related U.S. Application Data

(63) Continuation of application No. 16/401,450, filed on May 2, 2019, now Pat. No. 11,510,457.

(30) Foreign Application Priority Data

May 3, 2018 (EP) ..... 18170671.4

(51) Int. Cl.
*A43B 13/16* (2006.01)
*A43B 13/12* (2006.01)
*A43B 13/18* (2006.01)

(52) U.S. Cl.
CPC ..... *A43B 13/16* (2013.01); *A43B 13/125* (2013.01); *A43B 13/183* (2013.01)

(58) Field of Classification Search
CPC ... A43B 13/183; A43B 13/141; A43B 13/181; A43B 13/185; A43B 7/32
See application file for complete search history.

(56) References Cited

U.S. PATENT DOCUMENTS

2004/0148798 A1* 8/2004 Wu ..... B29D 35/062 36/12

* cited by examiner

*Primary Examiner* — Patrick J. Lynch

(57) ABSTRACT

A sole for sports shoes is provided including a base or tread component, a top or midsole component and a least one intermediate or elastic cushioning component. Advantageously, the sole if able to provide high cushioning, elastic yield and stability thanks to the mechanical or structural characteristics of the sole.

13 Claims, 7 Drawing Sheets

SOLE FOR A SPORTS SHOE

TECHNICAL HELD OF THE INVENTION

The present invention relates to a sole for sports shoe, as well as sports shoe comprising such a sole.

STATE OF THE ART

Many sports shoes, which usually include a midsole and an outer sole with a tread pattern, have been proposed.

The European patent application published with No. EP2279678A1 teaches, e.g., a shoe having a sole formed by two parts of rubber or thermoplastic tread pattern, a heel insert, a first midsole element and a second midsole element, such first midsole element is clamped between the second midsole element and the heel insert, and is formed in a single piece of plastic material.

The first midsole element has a double leaf spring elastic structure, with a substantially oval section which forms a through opening from the medial side to the lateral side of the sole.

The sole structure described in the aforementioned European patent application, does not guarantee a correct distribution of the forces, in particular at the first midsole element.

Moreover, such element does not allow obtaining a suitably differentiated cushioning, elastic yield and stability.

OBJECTS OF THE INVENTION

It is an object of the present invention to provide an improved sole for sports shoes.

Another object of the present invention is to provide a sole as above indicated which guarantees a cushioning, an elastic yield and a stability improved in respect to traditional soles.

Another object of the present invention is to provide a sole that is able to guarantee high cushioning, elastic yield and stability thanks to the mechanical or structural characteristics of the sole.

Another object of the present invention is to provide a sole that does not lose its mechanical characteristics over time.

Another object of the present invention is to provide a sole which is able to guarantee a cushioning, an elastic yield and a stability differentiated from the inside to the outside.

In accordance to one aspect of the invention a sole according to claim 1 is provided.

The dependent claims refer to preferred and advantageous examples of embodiments of the invention.

BRIEF DESCRIPTION OF THE DRAWINGS

Other characteristics and advantages of the invention will be more evident from the description of examples of embodiments of a sole, illustrated by way of example in the accompanying drawings wherein.

In the accompanying drawings, identical parts or components are distinguished by the same reference numerals.

EXAMPLE OF EMBODIMENTS OF THE INVENTION

Figure 1:
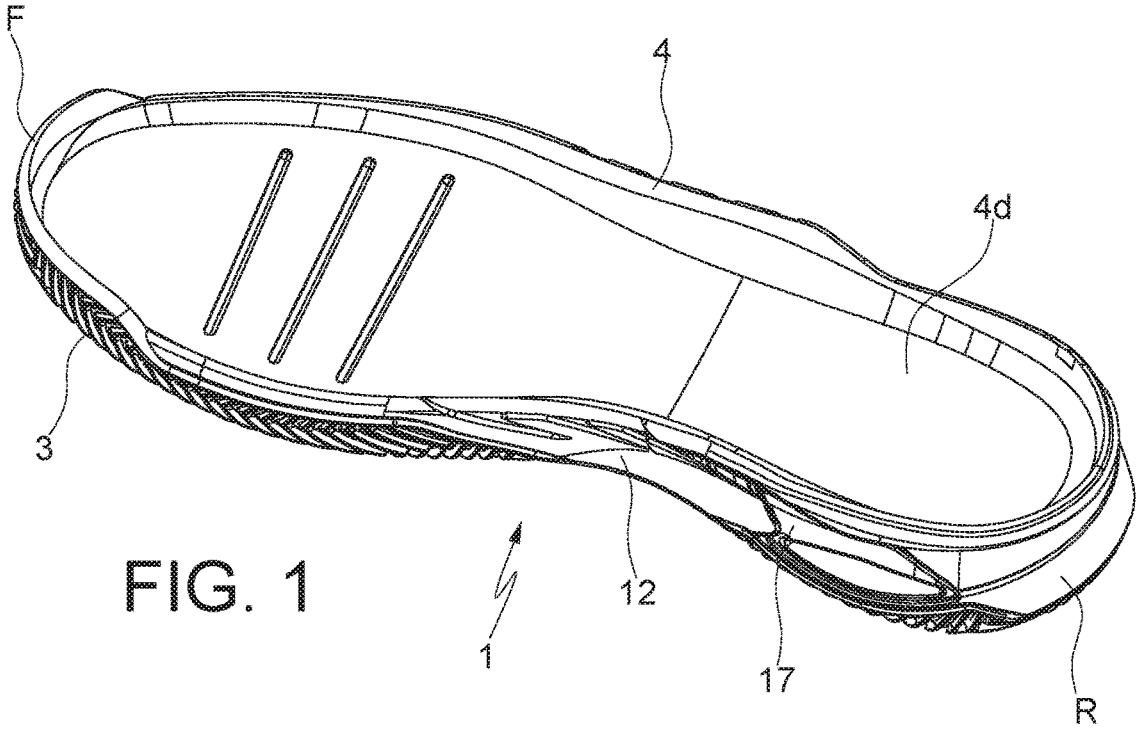
FIGS. 1 and 2 are perspective views slightly from above and from respective sides of a sole according to the present invention.
Figure 2:
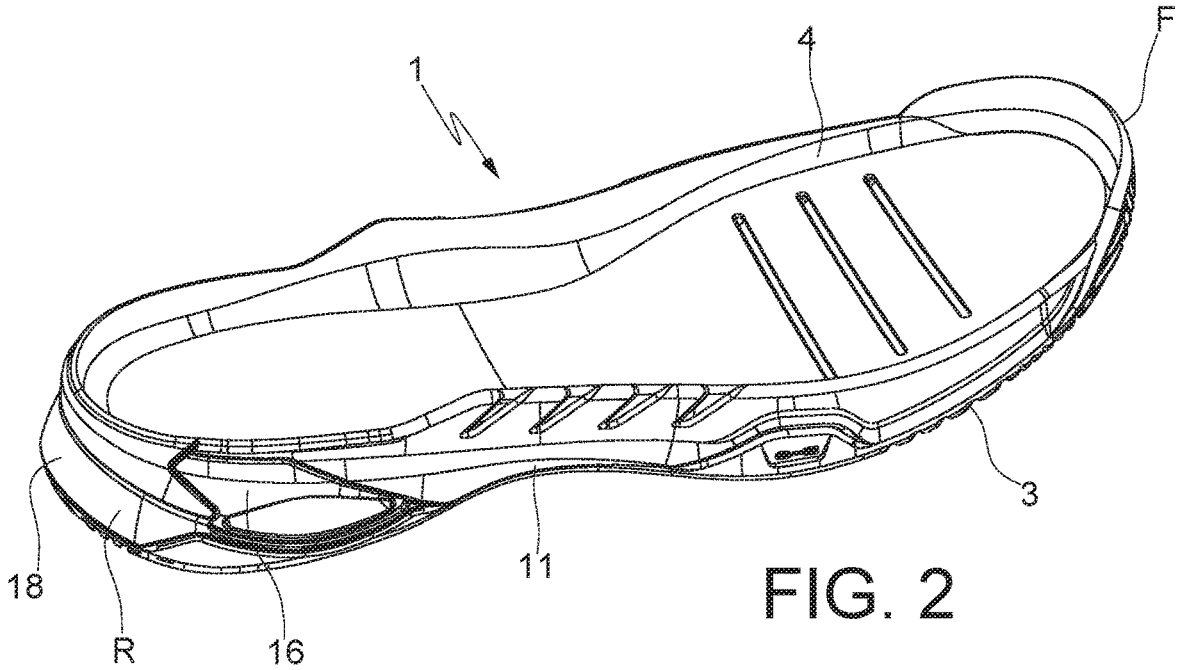
Figure 3:
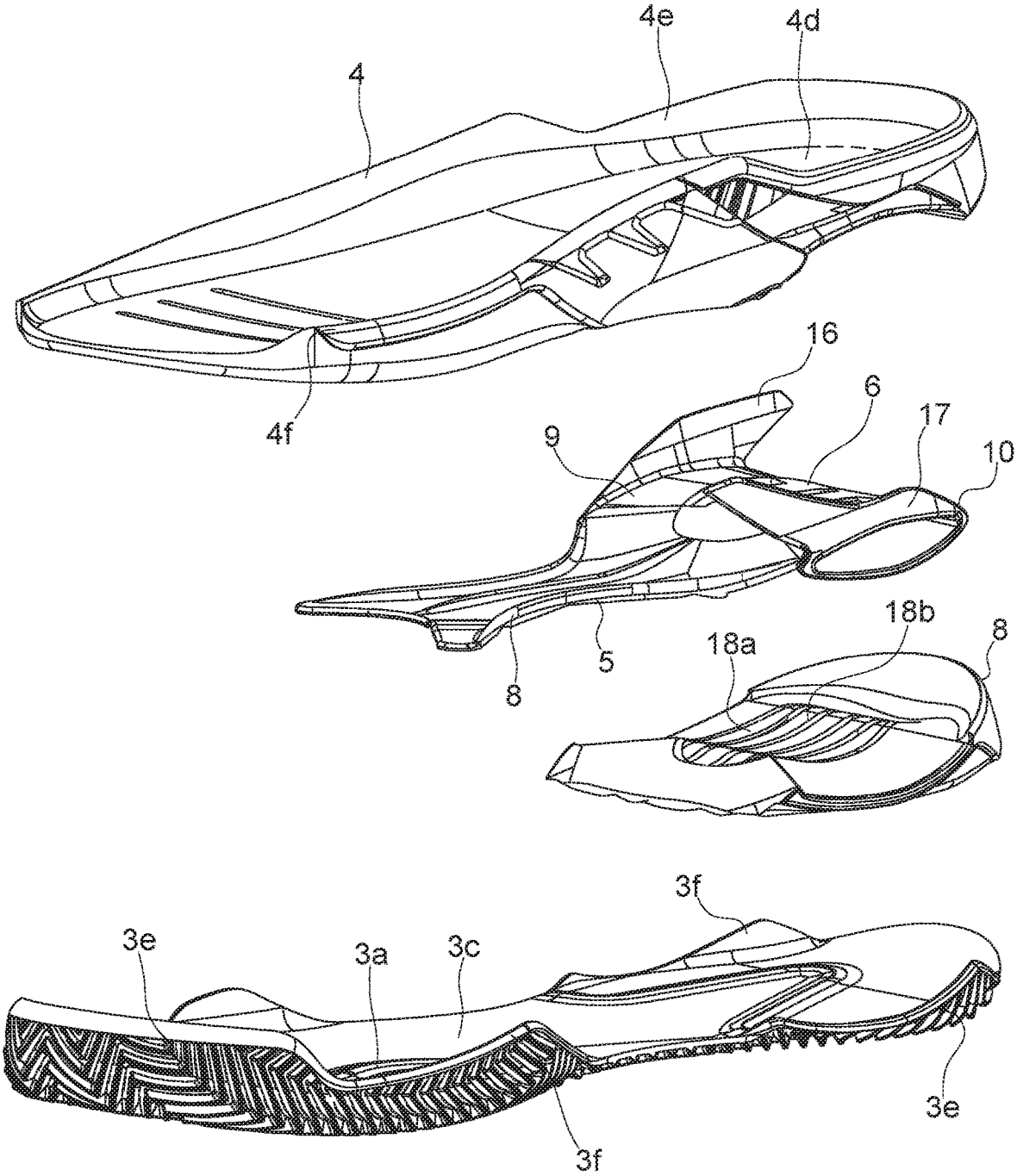
FIGS. 3 and 4 are exploded perspective views of the sole of FIG. 1.
Figure 4:
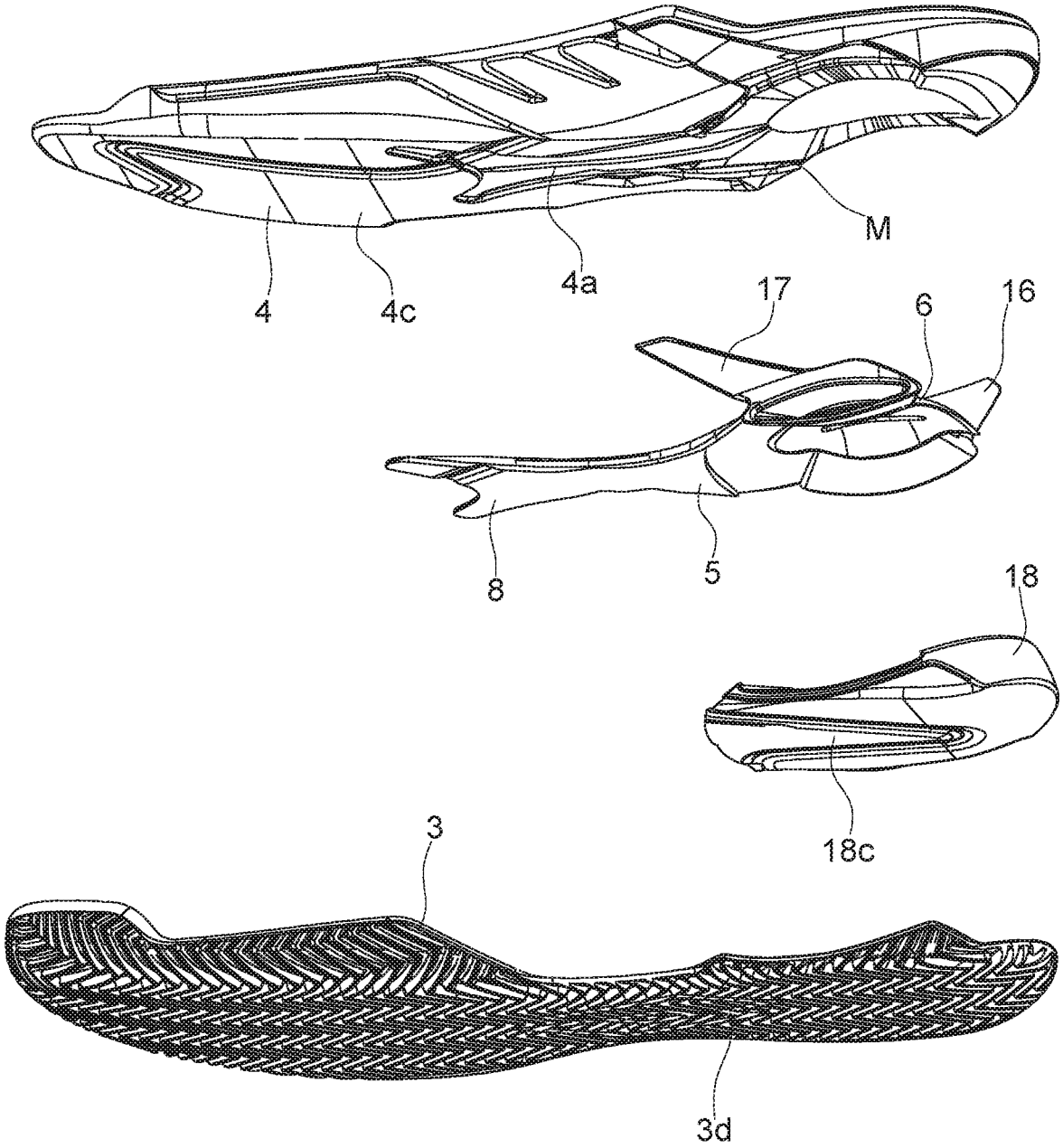
Figure 5:
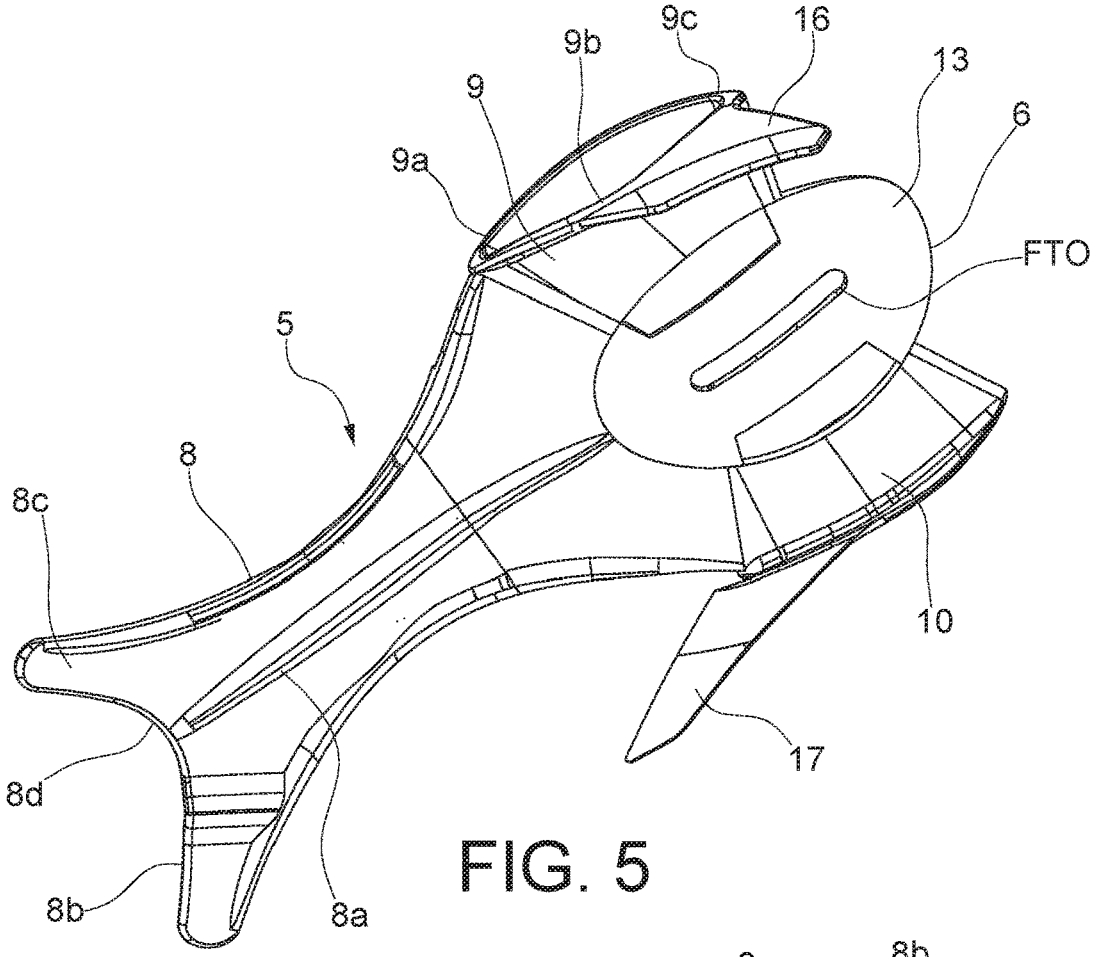
FIGS. 5 and 6 are perspective views of an intermediate component of the sole of FIG. 1.
Figure 6:
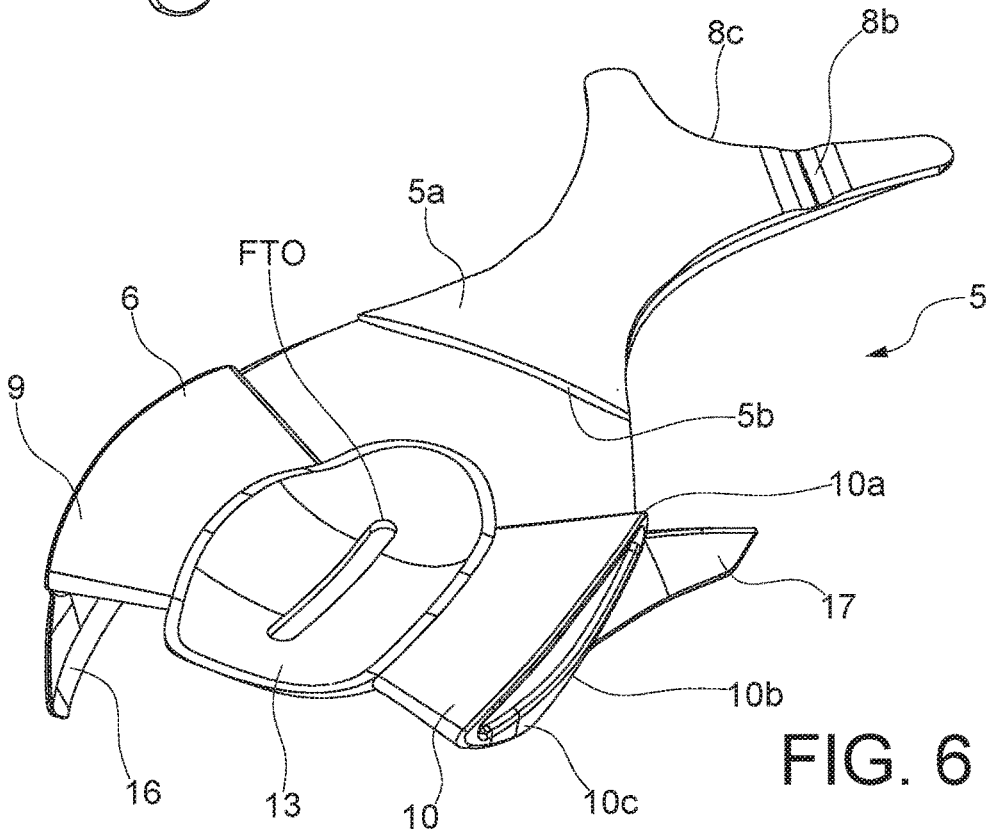
Figure 7:
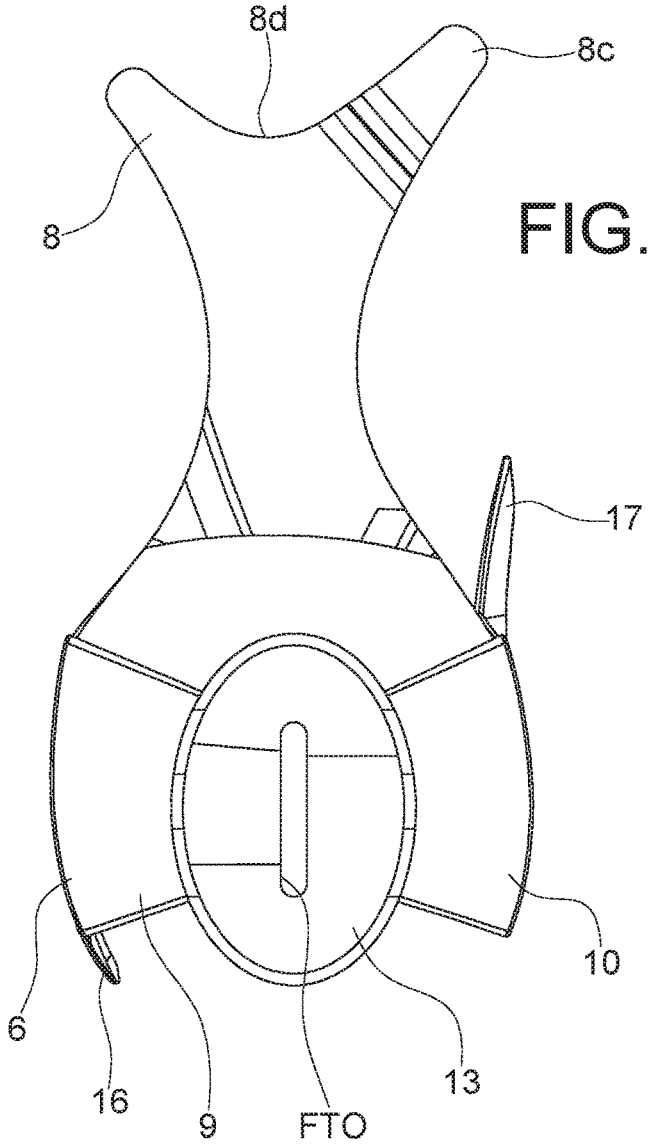
FIGS. 7 and 8 are plan views from above and below of the intermediate component of FIG. 5.
Figure 8:
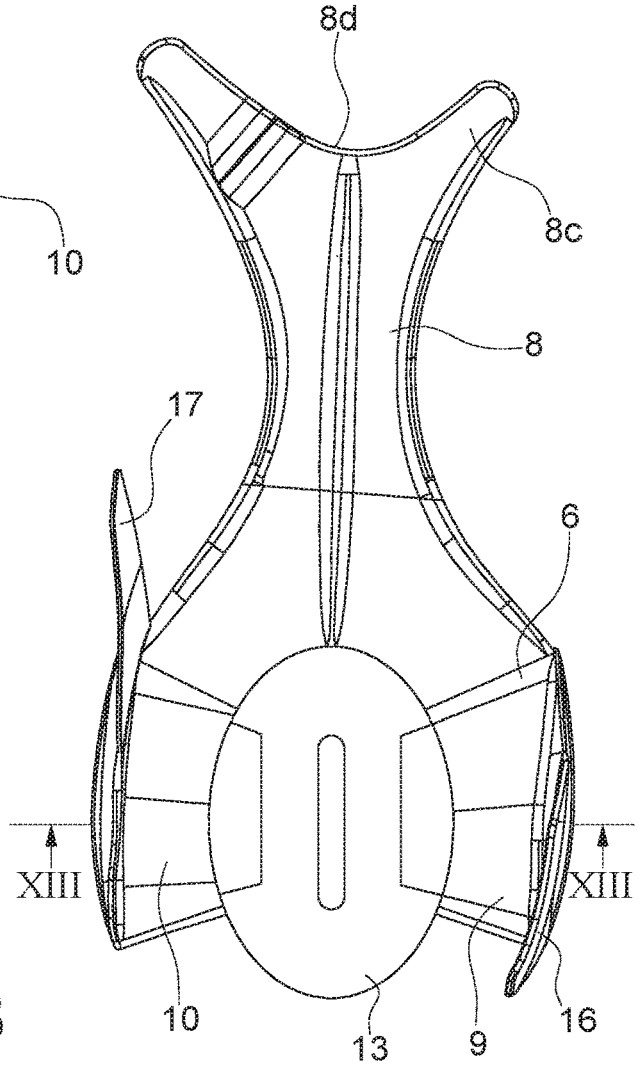
Figure 9:
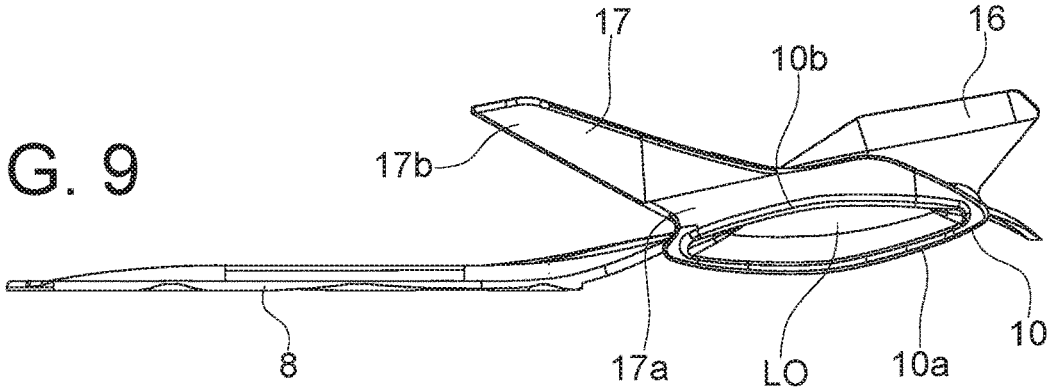
FIGS. 9 and 10 are views from respective sides of the intermediate component of FIG. 5.
Figure 10:
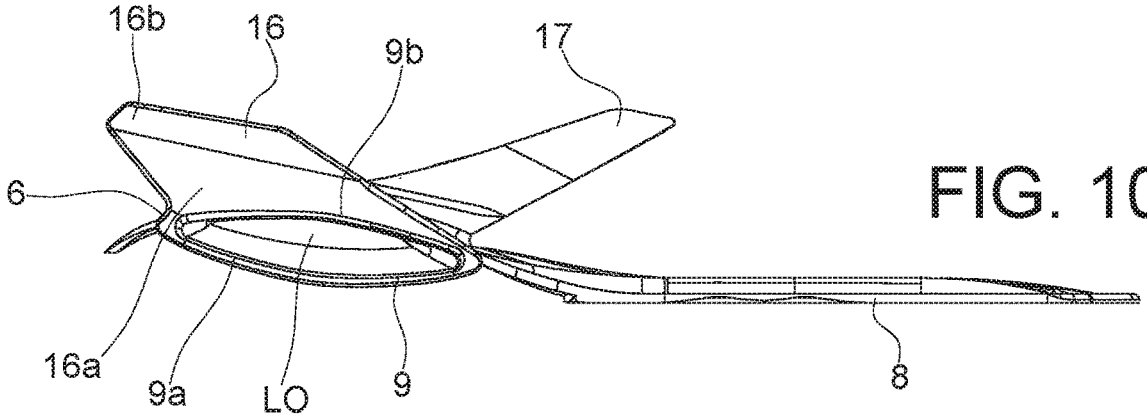
Figure 11:
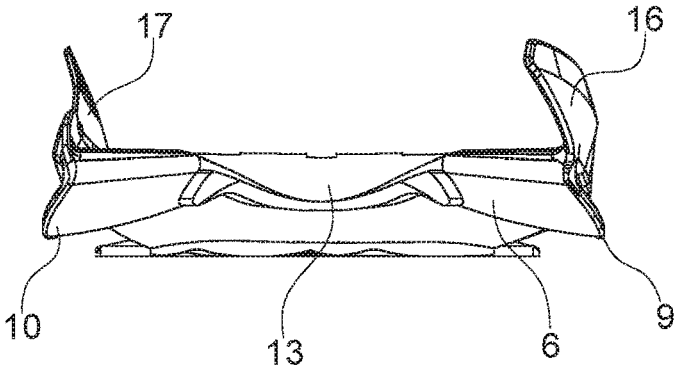
FIGS. 11 and 12 are views, respectively from front and rear of the intermediate component of FIG. 5, respectively.
Figure 12:
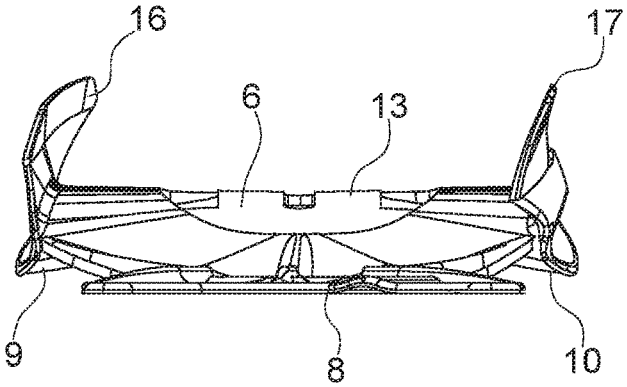
Figure 13:
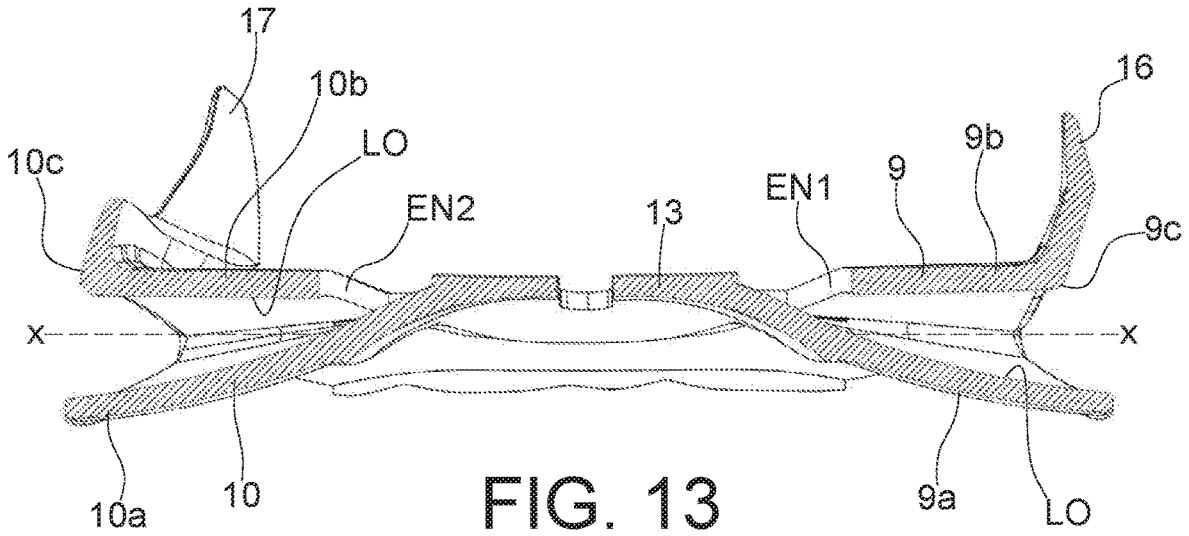
FIG. 13 is a view taken along according to the line of FIG. 8.

With reference to FIGS. 1 to 14, a sole 1 for a sports shoe 2, such as a running, a football or a tennis shoe, comprising a base component or, if desired, a tread component 3, a top component or midsole 4 and at least one intermediate component or elastic cushioning component 5 placed and packaged between base component 3 and top component 4. According to a less preferred variation, the elastic cushioning component 5 could be arranged on or above the top component or midsole 4, i.e., opposite to the base or tread component 3 with respect to the top or midsole component 4, or above, during use, the internal surface 4c of the top component 4.

More in particular, the intermediate or elastic cushioning component 5 is a single piece and comprises a rear portion 6 arranged at the heel or rear R level of the sole 1 and a front portion 8 extending towards the tip or front F starting from the rear portion 6 so as to engage a zone at the waist edge or intermediate part of the sole.

The intermediate component 5 can, e.g., be made of a material selected from the group consisting of a thermoplastic material, such as PEBAX® or a polyamide, a thermoplastic polyurethane.

Moreover, such component can be made in a single piece by moulding the whole component 5, or also by realizing the various parts and fixing them unmovably to each other, if desired by gluing.

The rear portion 6 of the intermediate component 5 includes two lateral tubular sections 9, 10 each extending at a respective side 11, 12 of the sole 1 and a central section 13, preferably of plate-like shape, bridge connecting the two lateral sections 9, 10, the central connecting section 13 having a configuration different from the two lateral tubular sections 9, 10, thereby obtaining a behaviour reacting to pressure or crushing, in particular applied by a foot of a user, inserted in the shoe 2, such as different cushioning, elastic yield and stability during use of the sections of the rear portion 6 from one side 11 to the other side 12 of the sole 1.

As said, the central section 13 is preferably plate-like, but it could also be tubular, e.g. with a cross-section, i.e. taken along a plane orthogonal to the rear R-front F direction, different and especially lower or more crushed than the one of the lateral tubular sections 9, 10.

The lateral tubular sections 9, 10 are therefore one opposite to the other with respect to the central section 13 and each extends from a respective end of the central section 13. If desired, more pairs of lateral tubular sections are provided opposite with one another with respect to the central section.

The lateral tubular sections 9, 10 each extend between about ¼ and ⅓, e.g. about ⅓ of the width of the rear portion 6, then in the direction from one side 11 to the other side 12 of the sole.

Advantageously, the central plate-like connecting section 13 is substantially curved with a concavity facing towards the base component 3 and, even more advantageously, it is open towards the bottom or even better towards the base component 3, i.e. that the intermediate component 5 does not have a lower closing section of the central plate-like connecting section 13. Moreover, one, two, three or more first through openings FTO can be formed in the central section 13, with a main extension substantially aligned with the rear R-front F direction of the sole 1. The first through openings FTO, if provided, can have different geometric shapes, also as a circle or rectangle, if desired.

If desired, each of the tubular sections 9, 10 delimits a longitudinal opening LO, e.g., extending around a longitudinal extension axis x-x (see in particular FIG. 13) transverse or orthogonal to the rear R-front F direction of the sole. The longitudinal extension axis x-x of the two longitudinal through openings LO may be the same or not; e.g., the longitudinal extension axes of the longitudinal openings LO may be inclined with respect to each other.

The longitudinal extension axis x-x is not necessarily a longitudinal symmetric axis of the tubular sections 9, 10.

Each longitudinal opening LO, if provided, can open externally at a respective side 11, 12 of the sole 1 and, if desired, also internally in a respective discharge or relief groove EN1, EN2 defined or delimited in the central connecting section 13, in an inner end of a respective tubular section 9, 10 or between central connecting section 13 and an inner end of a respective tubular section 9, 10. One or each discharge or relief groove EN1, EN2 is also preferably open towards the top component 4 or towards the base component 3 (towards the top component 4 according to the example of embodiment illustrated in the figures).

The discharge or relief groove(s) EN1, EN2, if provided, confer greater elasticity or freedom of elastic deformation both to the tubular sections 9, 10, and to the central section 13.

The tubular sections 9, 10 may have a first curved segment or two or more first segments inclined one with respect to the other 9*a*, 10*a* so as to define a concavity or recessed zone facing the top component 4, which first segment(s) 9*a*, 10*a* is/are proximal to the base component 3 and a second curved segment or two or more second segments inclined one with respect to the other 9*b*, 10*b*, so as to define a concavity or recessed zone facing the base component 3, which second segment(s) 9*b*, 10*b* is/are proximal to the top component 4.

The segments 9*a*, 9*b*, 10*a*, 10*b* each extend from a respective end of the central section 13.

Advantageously, the central connecting section 13 is substantially aligned or at the same level of the second segment 9*b*, 10*b* or of the first segment 9*a*, 10*a* of the tubular sections 9, 10, while the remaining between the first segment 9*a*, 10*a* and the second segment 9*b*, 10*b* extends at a different level and, respectively, closer to or more distant from the base component 3 than the central connecting section 13.

Even more advantageously, the central connecting section 13 is substantially aligned or at the same level of the second segment 9*b*, 10*b*, while the first segment 9*a*, 10*a* extends starting from the central section 13 towards a respective side 11, 12 and towards the base component 3.

Preferably, the tubular sections 9, 10 have a substantially conical configuration or in any case with a circular or ellipsoidal, but also polygonal section, if desired which decreases towards the central connecting section 13 or the respective binding or connecting end with the latter, thereby the width of one or each longitudinal opening LO tapers while approaching the longitudinal centre or centreline of the sole 1, so as to be substantially equal to zero at the central connecting section 13, thus with the inner end of the first segment 9*a*, 10*a* which is near to or in contact with the inner end of the second segment 9*b*, 10*b*. Clearly, the inner ends of the first segment 9*a*, 10*a* and of the second segment 9*b*, 10*b* correspond to the ends of the central section 13.

In this case, one or each discharge or relief groove EN1, EN2 is defined or delimited at a first segment 9*a*, 10*a* or at a second segment 9*b*, 10*b*, in particular at the inner end of one of them, i.e. the connecting or binding end with the central section 13.

The thickness of the wall of one or more the elements of the intermediate component 5, in particular of the lateral tubular sections 9, 10 and/or of the central plate-like section 13 is preferably constant, for example between 1 and 10 mm, but it can also be variable from one side to the other and/or from the rear R to the front F, e.g., between 1 and 10 mm The sole 1 may also have teeth or ribs extending into one or both longitudinal openings LO, preferably from a wall section delimiting the longitudinal openings LO to another wall section and therefore not cantilever teeth or ribs.

Moreover, in the longitudinal openings LO a filling component can be inserted in suitably soft material.

The intermediate component 5, or more specifically, the respective rear portion 6 can actually comprise a leaf spring, with the central section 13 which constitutes the main elastically yielding element of the leaf spring, while the lateral tubular sections 9, 10 represent elastically crushable ends of the leaf spring.

In this regard, the central section 13 is movable between a first resting position, e.g. wherein the central section 13 delimits a concavity facing towards the base component 3, and at least one working or crushing position, wherein the central section 13 delimits a convexity facing the base component 3 or a concavity of lower entity than the first position. This movement is clearly controlled by the pressure or crushing exerted on the sole by the foot of a user inserted in the shoe 2.

When the user exerts a pressure on the sole 1, crushes the lateral tubular sections 9, 10 instead, therefore the width of the longitudinal openings LO is reduced.

Following such movement or crushing, both the central section 13 and the lateral tubular sections 9, 10 are elastically loaded and once the pressure is reduced, e.g. because a user lifts his foot and then the shoe with the sole 1, the sections 9, 10 and 13 tend to return to the resting position or in the initial position not moved or crushed by applying a relative force to the user's foot. With regard to such aspect, as will be understood, the force applied by the sections 9, 10 and 13 is a reaction force which is a function of the pressure initially applied to them and, moreover, the force applied by each section is independent from the force applied by the others due to the configuration of the rear portion 6.

If desired, the intermediate component 5 also comprises at least one tab 16, 17, during use, extending from the external end 9*c*, 10*c* of one or both the lateral tubular sections 9, 10 and wrapping a respective part of the top component 4. Said tab 16, 17 can extend in an upward or outward direction from the base component 3 and towards the front F or the rear R of the sole 1.

Advantageously, a first tab 16 is provided, during use, extending from the external end 9*c* of the lateral tubular section 9 at the lateral side 11 of the sole and a second tab 17, during use, extending from the external end 10*c* of the lateral tubular section 10 at the medial side 12 of the sole 1. More particularly, the first tab 16 extends upwardly or away from the base component 3 and towards the rear R of the sole 1, while the second tab 17 extends upwardly or away from the base component 3 and towards the front F of the sole 1.

One or each tab 16, 17 may extend from a respective second segment 9*b*, 10*b* and have an extension equal to the latter.

If desired, the first tab 16 may have gradually decreasing width moving away from the respective second segment 9*b* with the end 16*b* between around ⅔ and ¾ with respect to the connecting portion 16*a* with the second segment 9*b*.

The second tab 17 may have a wide base or binding section 17*a* at the respective second segment 10*b* and therefore a stem portion 17*b* of much smaller width, e.g. between ¼ and ½, with respect to the base portion 16*a*.

The "lateral" side 11 refers to the side, in use, external of the sole or in any case to the side, during use, facing away from the other sole of a pair of soles. The "medial" side 12, on the other hand, refers to the side, in use inner of the sole or in any case the side, during use, facing towards the other sole of a pair of soles.

On the other hand, the front portion 8 of the intermediate component 5, may be substantially plate-like, optionally with one or more ribs 8*a* or grooves 8*b* or in any case projections designed to be to size or with loose engaged in respective openings or protuberances 3*a*, 4*a* of the base component 3 or the top component 4.

Moreover, the front portion 8 can have a suitably shaped tip or end 8*c*, e.g. C-shaped, if desired curved so as to delimit a concavity or convexity or recessed zone 8*d* facing the front of the sole.

The front portion 8 can be, e.g., substantially flat.

If desired, the front portion 8 may have a decreasing width moving away from the rear portion 6 or decreasing for a part of its extension, e.g., up to a width comprised between ⅓ and ⅔ or between ½ and ⅔ of the width or width of the rear portion 6 and then increasing up to the tip 8*b*. The front portion 8 could also have the same width and length as the base component 3 or a rectangular configuration or another shape, depending on the type of shoe to be made.

The sole 1 could comprise a heel insert 18 placed and packaged between the rear portion 6 of the intermediate component 5 and the base component 3. The heel insert 18 could also be realized in one piece with the base component 3 or the top component 4. If, e.g., the heel insert 18 is in one piece with the top component 4, then they could be realized constrained only at a respective end.

The heel insert 18 is designed to support the intermediate component 5 from below or in any case starting from a zone between the intermediate component 5 and the base component 3. If desired, the heel insert 18 delimits a first surface 18*a* distal from the base component 3, in contact and, if desired, in substantial shape coupling with the surface 5*a* of the intermediate component 5 which is lower or facing towards the base component 3, which surface is defined both by the central plate-like section 13 and by the lateral tubular sections 9, 10. The first surface 18*a* can be curved with a concavity facing the top component 4. In this regard, the surface 5*a* may have a step or the like 5*b* engaging a front edge or in any case a respective section of the heel insert 18.

If desired, the heel insert 18 delimits grooves 18*b*, preferably non-through, which may be associated to the first surface 18*a*.

The heel insert 18 may have a thickness varying in the rear R-front F direction and more particularly the first decreasing and then slightly increasing.

The second surface 18*c* of the heel insert 18, i.e. the surface of the same proximal or in contact with the inner, during use, surface 3*c* of the base component 3 can be substantially flat, optionally with grooves or protuberances in shape engagement with loose or not with respective sections of the surface 3*c*.

The heel insert 18, if provided, is preferably made of EVA (ethylene vinyl acetate), polyurethane (PU), thermoplastic rubber (TPR), rubber, thermoplastic polyurethane (TPU) foam, gel or a mixture thereof.

The heel insert 18 guarantees or contributes to improve the absorption of vibrations and the elastic yield of the sole 1.

The top component 4 can define a recessed impression M wherein the intermediate component 5 is housed substantially to size or with slight loose.

The base component 3 and the top component 4 each comprise a respective plate suitably shaped so as to have a flat or slightly curved main surface which is internal 3*c*, 4*c* and external 3*d*, 4*d* and a suitably raised edge 3*e*, 4*e*, that could not be for the whole respective perimeter.

The base component 3 and the top component 4 are mutually coupled or constrained, if desired by means of support or contact of the respective internal main surfaces 3*c*, 4*c* for part of their extension and fitting or support of one or more edge sections 3*f* of one between base component 3 and top component 4 in a respective recess or cavity 4*f* delimited by the other between top component 4 and base component 3.

The base component 3 and the top component 4 are, preferably, rigidly fixed to each other, by means of glue and/or adhesive.

These components 3, 4 mutually delimit the positioning zone of the intermediate component 5 and, if provided, of the heel insert 18.

Therefore, the intermediate component 5 may protrude laterally and/or on the rear R with respect to the zone delimited by the base component 3 and the top component 4, if desired, at the tabs 16, 17.

The heel insert 18, if provided, may protrude laterally and/or on the rear R with respect to the zone delimited by the base component 3 and the top component 4, in particular, at the rear R of the sole 1.

The base component 3 and/or the top component 4 is/are, preferably, each in a single piece. According to a less preferred variation, the base component 3 and the top component 4 are made in one piece, which can be suitably cut for the insertion (if provided) between them of the intermediate component 5.

Moreover, in the frontal zone of the sole 1, where the intermediate component 5 does not extend or is not provided, the inner surface 3*c* of the base component 3 is preferably in contact with the internal, during use, surface 4*c* of the top component 4. In this regard, the thickness of the components 3, 4 may be variable or constant.

The base component 3 is preferably made of a material selected from the group consisting of rubber, TPR, TPU, PU, EVA or a mixture thereof.

The base component 3 can have a plurality of studs, externally.

The top component 4 is preferably made of a material selected from the group consisting of EVA, PU, TPR, expanded TPU or a mixture thereof.

Figure 14:
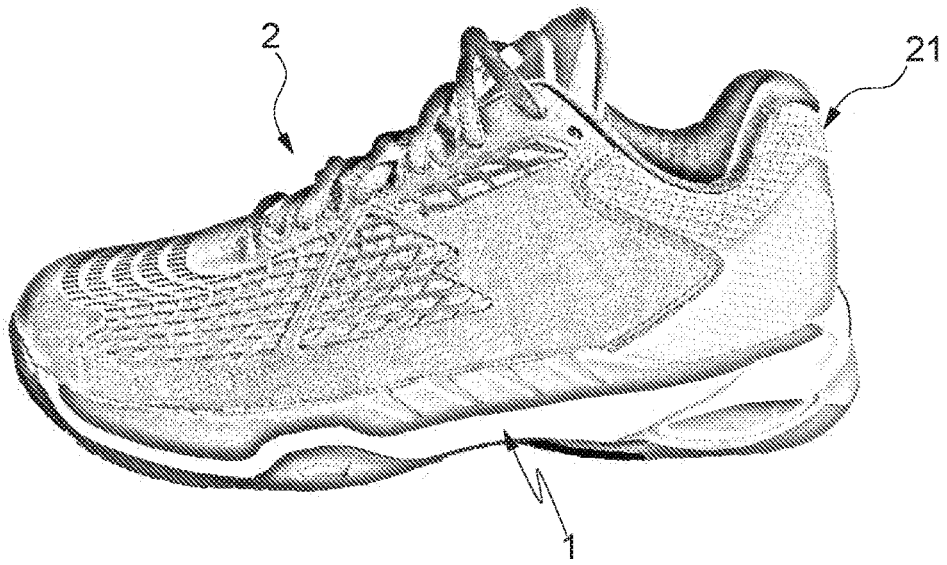
FIG. 14 is a lateral view of a shoe according to the present invention.

According to the present invention, a shoe 2 is also provided, see e.g. FIG. 14, comprising a sole 1 as described above and an upper 21 constrained to the top component 4 of the sole 1, e.g. glued to said component, particularly at the main external surface 4*d* thereof. Clearly, when the upper 21 is constrained to the sole, such surface 4*d* is no longer external or in view. In the case wherein the elastic cushioning component 5 is arranged above the top component or midsole 4, then the upper may also be constrained to the elastic cushioning component 5.

The shoe 2 can then also of course be provided with an insole.

As will be understood, due to a sole according to the present invention it is possible to obtain a correct central and also lateral cushioning in particular at the back or rear part of the sole 1.

Clearly, the central cushioning is guaranteed mainly by the central section 13, while thelateral cushioning is provided by the lateral tubular sections 9, 10.

Moreover, thanks to the sections 9, 10 and 13 of the rear portion of the intermediate component and in particular thanks to the different configuration thereof, a behaviour is achieved, such as cushioning, elastic yield and stability different from one side 11 to the other side 12 of the sole.

This in particular is due to the leaf spring configuration of the intermediate component 5 and more particularly of the rear portion 6 thereof.

As said, in fact, upon movement or crushing of the sole, both the central section 13 and the lateral tubular sections 9, 10 are elastically loaded and once the pressure is reduced, e.g. because a user lifts his foot and then the shoe with the sole 1, the sections 9, 10 and 13 tend to return to the resting position or in the initial position not moved or crushed by applying a respective (reactive) force to the user's foot.

In this regard, the structure of the central section 13, of the tubular sections 9, 10 and the position of the discharge or relief openings EN1, EN2 allows to release the cushioning, the elastic yield and the stability of the sections of the rear portion 6.

With regard to this, clearly, the stress and performance of the inside and the outside of the foot are different, so that the structure of a sole according to the present invention allows to comply with this aspect and to guarantee performance greater than the soles proposed so far.

An excellent impact absorption and elastic return is therefore obtained, which is properly distributed both longitudinally and transversely.

Modifications and variations of the invention are possible within the scope of protection defined by the claims.

What is claimed is:

1. A sole for a shoe comprising:

a base component, a top component, and at least one intermediate component disposed between said base component and said top component, wherein said at least one intermediate component includes a rear portion arranged at a level of a heel of the sole and a front portion extending towards a front starting from the rear portion, in order to engage a zone at an intermediate part of the sole, wherein said rear portion of said intermediate component includes a first lateral tubular section and a second lateral tubular section, said first lateral tubular section at a lateral side of the sole and said second lateral tubular section at a medial side of the sole, wherein the first lateral tubular section comprises a first end at the lateral side of the sole and a second opposite end between the lateral side and the medial side of the sole, wherein the second lateral tubular section comprises a first end at the medial side of the sole and a second opposite end between the medial side and the lateral side of the sole, said at least one intermediate component further comprising a central section connecting said first lateral tubular section and said second lateral tubular section, said central section comprising a different configuration from said first lateral tubular section and said second lateral tubular section, thereby enabling a behavior reacting to pressure different from said first lateral tubular section and said second lateral tubular section, wherein said central section comprises an open curved configuration with a concavity facing toward said base component, wherein said first lateral tubular section and said second lateral tubular section each comprise a first curved segment and a second curved segment, each of said first curved segments defining a concavity facing said top component and each of said second curved segments defining a concavity facing said base component, wherein said first curved segment of each of said first lateral tubular section and said second lateral tubular section is contiguous with and extends in a downward angle from opposing ends of said central section, wherein a longitudinal opening of said first lateral tubular section opens internally at a first relief groove delimited at an inner end of said second curved segment of said first lateral tubular section, said first relief groove being open towards said top component, and wherein a longitudinal opening of said second lateral tubular section opens internally at a second relief groove delimited at an inner end of said second curved segment of said second lateral tubular section, said second relief groove being open towards said top component.

2. The sole according to claim 1, wherein said intermediate component comprises a leaf spring, with said central section which constitutes a main elastically yielding element of the leaf spring, while said first lateral tubular section and second lateral tubular section represent elastically crushable ends of the leaf spring.

3. The sole according to claim 1, wherein said central section has a cross-section taken along a plane orthogonal to the rear-front direction of the sole, different from that of the first and second lateral tubular sections.

4. The sole according to claim 1, wherein said first relief groove is delimited in said central section at said inner end of said second curved segment of said first lateral tubular section, and wherein said second relief groove is delimited in said central section at said inner end of said second curved segment of said second lateral tubular section.

5. The sole according to claim 1, wherein said first curved segment of each of said first lateral tubular section and said second lateral tubular section is proximal to said base component and wherein said second curved segment of each of said first lateral tubular section and said second lateral tubular section is proximal to said top component.

6. The sole according to claim 1, comprising at least one tab extending from an external end of one or both of the first and second lateral tubular sections and wrapping a respective part of the top component, said at least one tab extending in an upward direction or a direction away from the base component and towards a front of the sole or towards a rear of the sole.

7. The sole according to claim 6, comprising a first tab extending from an external end of the first lateral tubular section at the lateral side of the sole and a second tab extending from an external end of the second lateral tubular section at the medial side of the sole, the first tab extending away from the base component and towards the rear of the sole, while the second tab extends away from the base component and towards the front of the sole.

8. The sole according to claim 1, wherein said front portion of said intermediate component includes at least one rib designed to be engaged in respective openings of the base component or the top component.

9. The sole according to claim 1, comprising a heel insert placed and packaged between said rear portion of said intermediate component and said base component, said heel insert being designed to support the intermediate component from below or starting from a zone between the intermediate component and the base component.

10. The sole according to claim 9, wherein said heel insert delimits a first surface distal from the base component which is in contact and in a shape coupling with the surface of the intermediate component which is lower or facing towards the base component.

11. The sole according to claim 1, wherein said top component delimits a recessed impression wherein said intermediate component is housed.

12. A shoe comprising the sole according to claim 1 and an upper constrained to said top component of said sole.

13. A sole for a shoe comprising:

a base component;

a top component; and at least one intermediate component placed between the base component and the top component, wherein said at least one intermediate component comprises a single piece and comprises a rear portion arranged at a level of a rear of the sole, and a front portion extending towards a front starting from the rear portion, to engage a zone at an intermediate part of the sole, wherein said rear portion of said intermediate component comprises a first lateral tubular section and a second lateral tubular section, said first lateral tubular section at a lateral side of the sole and said second lateral tubular section at a medial side of the sole, wherein the first lateral tubular section comprises a first end at the lateral side of the sole and a second opposite end between the lateral side and the medial side of the sole;

wherein the second lateral tubular section comprises a first end at the medial side of the sole and a second opposite end between the medial side and the lateral side of the sole;

said intermediate component further comprises a central section connecting said first lateral tubular section and said second lateral tubular section, wherein each of said first lateral tubular section and said second lateral tubular section delimit a longitudinal opening extending around a longitudinal extension axis transverse to a rear-front direction of said sole, and wherein said first lateral tubular section and said second lateral tubular section each comprise a first curved segment and a second curved segment, each of said first curved segments defining a concavity facing said top component and each of said second curved segments defining a concavity facing said base component, wherein said central section is substantially aligned with each of said second curved segments, wherein said first curved segment of each of said first lateral tubular section and said second lateral tubular section is contiguous with and extends in a downward angle from opposing ends of said central section, wherein said first lateral tubular section and said second lateral tubular section comprise a configuration which decreases while approaching said central section, so that a width of said longitudinal openings taper while approaching a longitudinal centerline of the sole, and further comprising a first relief opening disposed in said central section at an inner end of said second curved segment of said first lateral tubular section, and a second relief opening disposed in said central section at an inner end of said second curved segment of said second lateral tubular section, said first relief opening and said second relief opening being open towards said top component.

* * * * *